United States Patent [19]

Luthi

[11] Patent Number: 4,827,741

[45] Date of Patent: May 9, 1989

[54] PULP WASHER DISCHARGING A PULP SLURRY AT A CONTROLLED CONSISTENCY

[75] Inventor: Oscar Luthi, Nashua, N.H.

[73] Assignee: Ingersoll-Rand Company, Woodcliff Lake, N.J.

[21] Appl. No.: 171,045

[22] Filed: Mar. 21, 1988

[51] Int. Cl.[4] ..... D21C 1/02

[52] U.S. Cl. ..... 68/43; 68/158; 68/181 R; 162/60; 162/329

[58] Field of Search ..... 8/156; 68/21, 43, 158, 68/181 R; 162/60, 317, 328, 329, 380

[56] References Cited

U.S. PATENT DOCUMENTS 3,772,144 11/1973 Luthi et al. ..... 162/329 X 4,217,170 8/1980 Luthi ..... 162/380

4,292,123 9/1981 Lintunen et al. ..... 8/156 X

*Primary Examiner*—Philip R. Coe

*Attorney, Agent, or Firm*—Walter C. Vliet

[57] ABSTRACT

An air-tight vat under pressure completely encloses a rotatable drum. The vat is constructed so that it may be completely submerged in liquid. The vat has a liquid filled take-off chamber. The pulp is fed to the vat through a pulp inlet. The pulp is formed and compacted to form a pulp mat. Directly following the forming and compacting of the pulp is a washing zone for washing the pulp mat. After washing the pulp mat is again compacted. The pulp mat is removed from the drum at a removal point located in the liquid filled take-off chamber, thus providing a pulp suspension in the take-off chamber. The suspension is removed from the vat through a pulp outlet extending from the liquid filled take-off chamber.

8 Claims, 4 Drawing Sheets

PULP WASHER DISCHARGING A PULP SLURRY AT A CONTROLLED CONSISTENCY

This invention relates to pulp washers. More particularly, this invention is a new pulp washer and pulp washing method which is used to provide a pulp slurry output having the desired consistency.

The cooked pulp from the digesters is filtered and washed with water to remove the black liquid that would contaminate the end product made from pulp and to recover the maximum amount of spent cooking chemicals with minimum dilution. Most of the pulp washing today is done in vacuum washers. A disadvantage of currently used vacuum washers of this type is that liquor extraction by air is undesirable in many processes because of foaming and chemical reactions.

The pulp washer described in U.S. Pat. No. 4,217,170 issued Aug. 12, 1980 and entitled "Pulp Washer Discharging a Low Consistency Pulp Slurry" in the name of Oscar Luthi describes a pulp washer which is substantially air-tight and completely encloses a rotatable cylinder on which the pulp mat is formed. Therefore, the air is eliminated and the undesirable effects of liquor extraction by air such as foaming and undesirable chemical reactions are no longer present in the vat. The pulp washer described in U.S. Pat. No. 4,217,170 has as an output a low consistency pulp slurry output.

This invention is a pulp washer and pulp washing method which is an improvement of the "Pulp Washer Discharging a Low Consistency Pulp Slurry" described in U.S. Pat. No. 4,217,170.

Briefly described, this invention is a pulp washer having a rotatable drum, an air-tight vat completely enclosing the rotatable drum. The vat is constructed so that the rotatable drum may be completely submerged in liquid so that the liquid surrounds the entire circumference of the drum. The vat has a liquid filled take-off chamber. The vat also has a pulp inlet with means directly following the pulp inlet for forming and compacting the pulp to form a pulp mat. The forming and compacting is followed by means for washing the pulp mat. After the washing, means are provided to again compact the pulp mat. This is followed by means for removing the pulp mat from the drum. The removal point is located in the liquid filled take-off chamber to provide a pulp suspension in said chamber. The pulp suspension is removed from the vat through a pulp outlet extending from the liquid filled take-off chamber.

The invention as well as its many advantages may be further understood by reference to the following detailed description and drawings in which.

In the various figures, like parts are referred to by like numbers.

Figure 1:
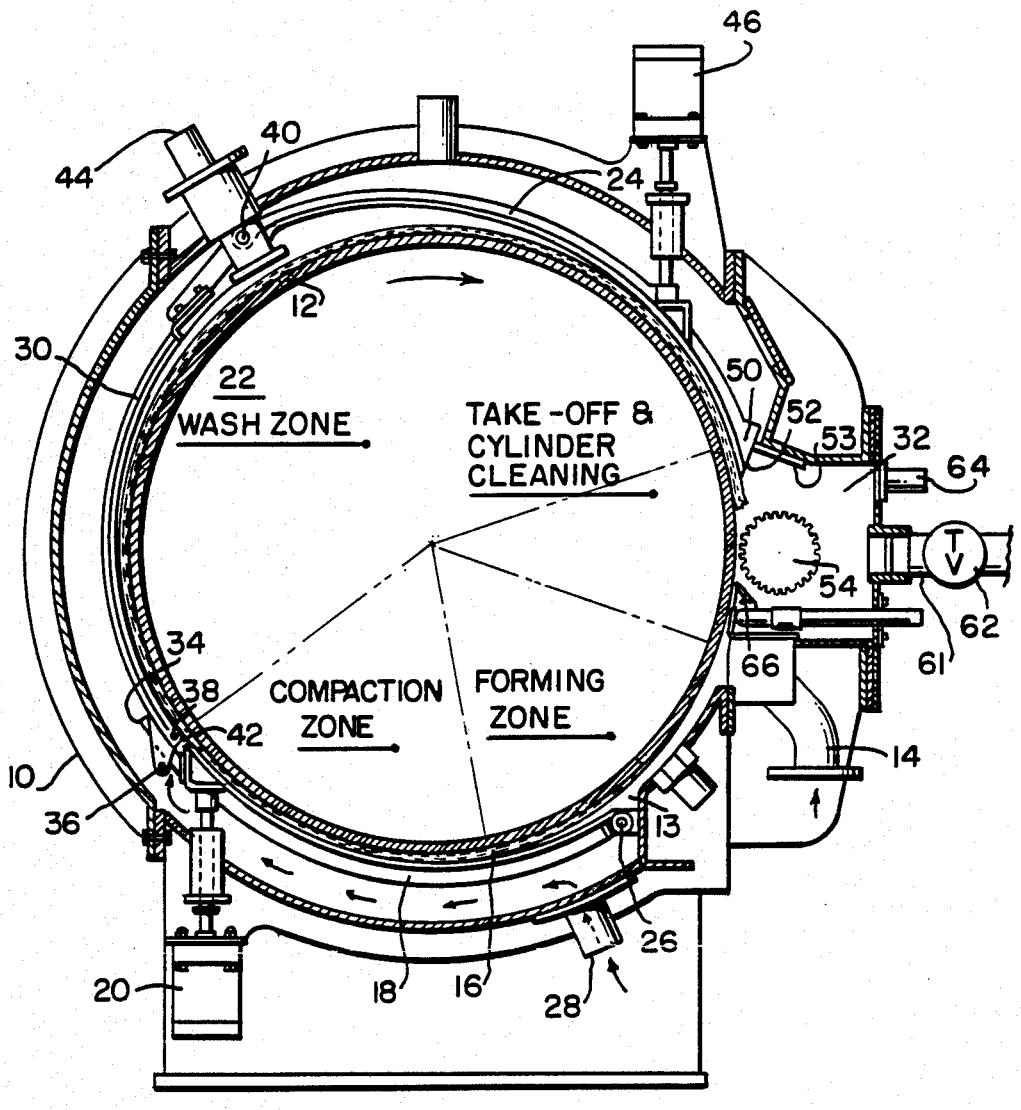
FIG. 1 is a front sectional view showing one embodiment of the invention.

Referring to the drawings and more particularly to FIG. 1, an air-tight vat 10 completely encloses a rotatable drum 12 which rotates in the vat 10. The rotatable drum has its lower section submerged in the pulp slurry which is introduced into the pulp slurry chamber 13 by means of pulp slurry inlet 14.

As the drum rotates, a pulp mat 16 is formed on the drum. This pulp mat may be compacted with a hydrodynamic baffle 18, serving as the primary baffle. The primary baffle 18 is mounted downstream from the pulp slurry inlet 14 and applies a compacting force against the mat being formed. The force is applied by means of actuators 20, one shown in FIG. 1. The hydrodynamic baffle 18 is preferably of a type that will compact the mat to a high consistency of say, 15% to 18% before entering the wash zone. During the remaining portion of the drum turning cycle, the compacted pulp mat 16 is washed by the application of a differential pressure across the circumferential wall of the rotatable drum 12 and the mat removed from the drum in the take-off chamber 32.

The air-tight vat 10 completely encloses the rotatable drum 12. The vat is constructed so that the rotatable drum is completely submerged in liquid so that the liquid surrounds the entire circumference of the drum.

The wash zone 22 extends from the downstream end of the primary compaction baffle 18 to the downstream end of the secondary compaction baffle 24. The wash zone 22 extends for more than 180° around the rotatable drum 12.

The primary compaction baffle 18 is pivotably connected at its upstream end to the vat by means of pivot 26. The primary compaction baffle converges gradually inwardly toward the outside surface of the rotatable drum 12 from its upstream end to its downstream end to cause the compaction of the pulp slurry into the mat 16. Wash liquid enters the vat 10 through wash liquid inlet 28 and also aids the actuators 20 in the application of the compaction force against the mat.

An excluder baffle 30 interconnects the primary compaction baffle 18 and the secondary compaction baffle 24.

The excluder baffle extends partially along the wash zone 22 from the compaction zone to the secondary compaction baffle 24 which extends partially along the wash zone 22 and into the liquid filled take-off chamber 32. In FIG. 1, the excluder baffle 30 diverges slightly from its upstream end to its downstream end. However, for certain types of pulp, the excluder baffle may be coaxial or even converge slightly from its upstream end to its downstream end.

The excluder baffle 30 slidably engages the primary compaction baffle 18. The primary compaction baffle 18 has a slidable guide 34 at its downstream end which slidably engages the spaced apart posts 36 and 38 on the upstream end of the excluder baffle 30. The secondary compaction baffle 24 and the excluder baffle 30 are pivoted from the same pivot point 40.

At start-up, washing liquid entering the first wash liquid inlet 28 will completely fill the vat. Thereafter, during operation washing liquid entering the first wash liquid inlet 28 flows along the outside of the primary compaction baffle 18. The space 42 between the downstream end of the primary compaction baffle 18 and upstream end of the excluder baffle 30 is provided so that the washing liquid also flows along the inside surface of coaxial baffle 30. The wash liquid thereafter flows along the inside surface of the secondary compaction baffle 24.

A second washing liquid inlet 44 is circumferentially located at the excluder baffle 30—secondary compaction baffle 24 connection. The liquid fed through the second washing inlet 44 flows along the inside surface of the converging secondary compaction baffle 24. The second washing liquid may be at a different temperature or concentration than the liquid fed through the wash liquid inlet 28.

Actuators 46 (one shown in FIG. 1) apply a compaction force against the mat 16.

The various zones: forming and compaction zones, wash zone and take-off zone, are preferably all at the same pressure. Thus, any seals need only be used to separate the liquids. Seals do not have to seal against a pressure differential. A close clearance gap is sufficient. The cylinder utilization is greatly increased when compared with other pulp washers. The active cylinder arc is approximately 330°; only 30° of arc is needed for mat take-off and cylinder cleaning. The downstream end of secondary compaction baffle 24 is shaped so that there is a close clearance gap between the downstream end 50 of the secondary compaction baffle 24 and the outside surface of the drum 12. The downstream end of the secondary compaction baffle 24 is also shaped so that its surface 52 remains in sliding contact with a side of a flat plate 53 mounted on the vat 10.

Usually, some of the pulp fibers will fall off the pulp mat 16 in the wash zone. With prior art washers, these pulp fibers float to the top of the vat and accumulate there. In time, a heavy wad may build up and plug the machine. The excluder baffle confines the fibers which have fallen off the mat to a small space and the washing action causes the pulp fibers to redeposit on the pulp mat.

Almost the whole circumference of the cylinder is surrounded by some kind of baffle. This leaves very little room for pulp to build up to a heavy wad and plug the machine. With both baffles in the open position, there is a divergent gap all around the cylinder to clear out any pulp.

The pulp mat 16 is again compacted by the secondary compaction baffle to 12% to 15% consistency and then enters the take-off chamber 32. A take-off roll 54 assists in removing the pulp mat from the drum.

Figure 4:
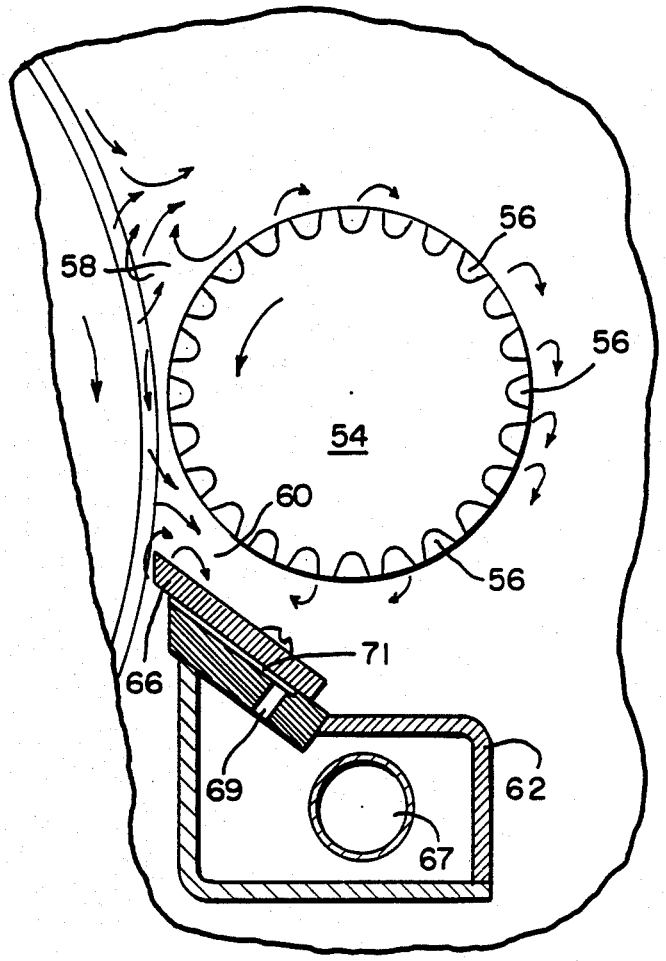
FIG. 4 is a fragmentary view on an enlarged scale illustrating the operation of the take-off roll and steam or water doctor of the embodiments of FIG. 2 and FIG. 3.

Referring to FIG. 4, the take-off roll 54 serves two functions: remove the pulp mat from the drum and convey the pulp longitudinally to the pulp outlet. The take-off roll shown in FIG. 4 includes a plurality of flutes 56 which are preferably arranged in a spiral pattern. A pressure zone 58 and suction zone 60 are created in the incoming and outgoing nip, respectively. This pressure and suction action will lift off the pulp mat from the cylinder. The lifted-off pulp mat is conveyed longitudinally by the spirally arranged flutes 56 in the take-off roller 54. The conveying of the pulp suspension is also assisted by a pressure drop in the take-off chamber 32 towards the throttle valve 62 in pulp outlet 61 (see FIG. 1). A dilution liquid inlet 64 is provided at the opposite longitudinal end of the take-off chamber 32 from the pulp outlet 61 for feeding dilution liquid into the take-off chamber 32. Thus, the consistency of the pulp in take-off chamber 32 may be adjusted over a wide range by feeding a predetermined amount of dilution liquid into the take-off chamber 32 by means of the dilution liquid inlet 64.

Underneath the take-off roll 54 is a doctor 66 which can be operated with steam or water or with a combination of steam and water fed through manifold 67, port 69, and slot 71. The doctor removes any remaining crumbs of pulp and cleans the drum for the next cycle.

The pulp is fed to the vat 10 through pulp inlet 14. The pulp is formed and compacted into a pulp mat 16 by the first compaction baffle 18. As the drum 12 rotates, the mat goes through the wash zone 22 on the drum 12 and under the excluder baffle 30 and secondary compaction baffle 24. The secondary compaction baffle 24 converges toward the drum from its upstream end to the downstream end to again compact the mat 16. As the mat 16 enters the take-off chamber 32, the take-off roll 54 removes the mat from the drum 12 and the pulp thus removed is longitudinally conveyed through the flutes of the take-off roll 54 to the pulp outlet 62. If desired, the consistency of the pulp from the pulp outlet 62 may be controlled by feeding dilution liquid into the take-off chamber 32 through dilution liquid inlet 64.

Figure 2:
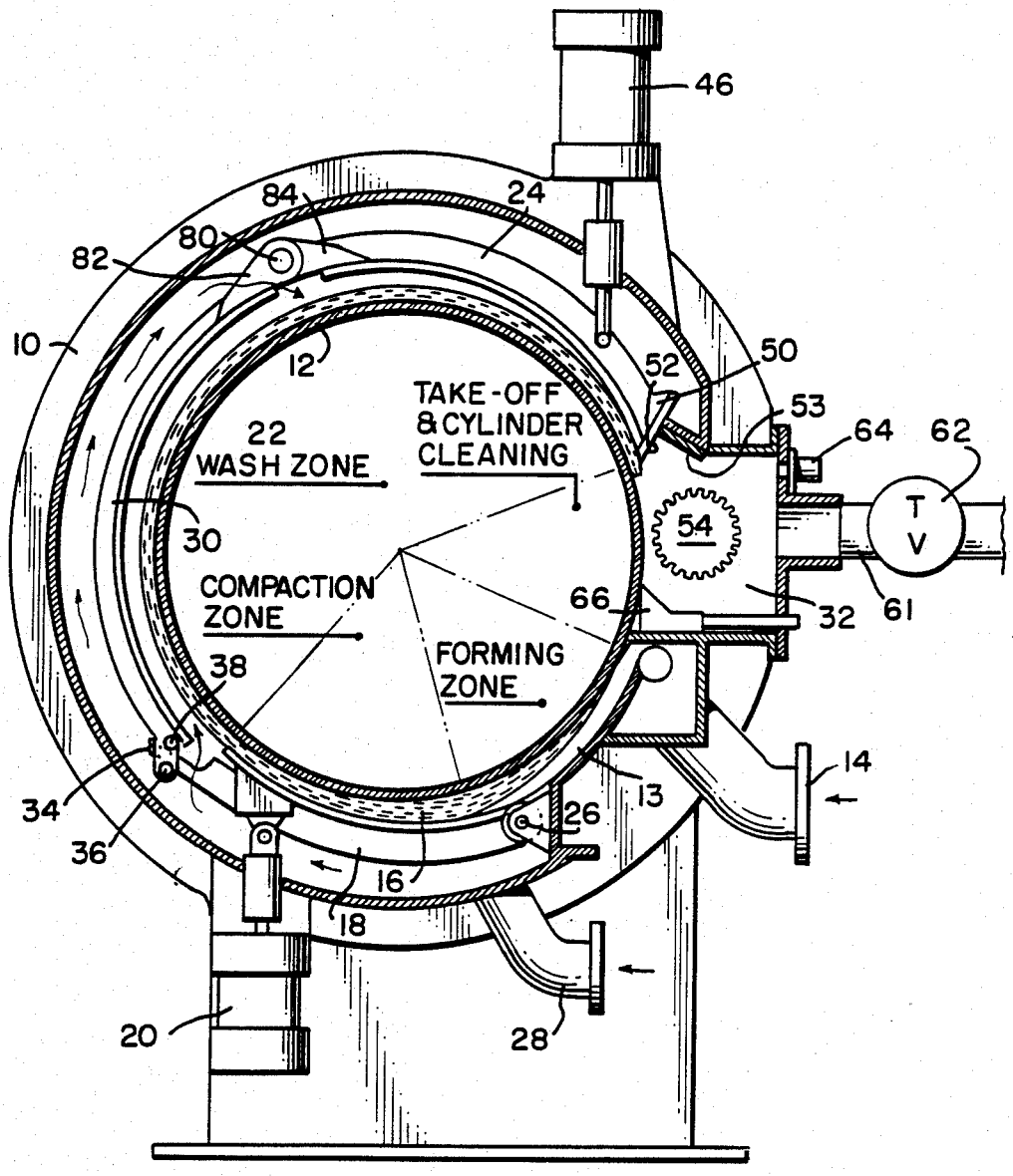
FIG. 2 is a front sectional view showing a second embodiment of the invention.

Most of the parts shown in the embodiment of FIG. 2 are the same as corresponding parts in FIG. 1 except that in the embodiment of FIG. 2, a single wash liquid inlet 28 is used. Thus, the secondary wash liquid inlet 44 of the embodiment of FIG. 1 is eliminated. Referring to FIG. 2, a longitudinally extending pivot 80 extends through a plurality of longitudinally separated pairs of brackets 82 and 84 (only one pair shown in the FIG. 2). Brackets 82 are connected to the downstream end of excluder baffle 30; brackets 84 are connected to the upstream end of the secondary compaction baffle 24. Since the pairs of brackets 82 and 84 are longitudinally separated, an opening exists between each pair of brackets so that after the start-up and the vat has been completely filled with liquid, wash liquid entering wash liquid inlet 28 flows along the outside surface of primary compaction baffle 18 then along the outside and inside surfaces of excluder baffle 30 and then along the inside surface of the secondary compaction baffle 24.

The operation of the pulp washer of FIG. 2 is similar to the operation of the pulp washer of FIG. 1. Pulp entering inlet 14 is compacted in the compaction zone by the primary compaction baffle 18 to form the mat 16. The mat 16 thereafter flows under the excluder baffle 30 and under the secondary compaction baffle 24 as it is washed in the wash zone of the drum. The secondary compaction baffle 24 again compacts the mat 16. In the take-off chamber 32, the mat is removed from the drum by the take-off roll 54 and longitudinally conveyed along the flutes of the take-off roll 54 to the pulp outlet 61 controlled by throttle valve 62. If desired, the consistency of the pulp from the take-off chamber 32 may be controlled by adding dilution liquid into the take-off chamber 32 through dilution liquid 64.

Figure 3:
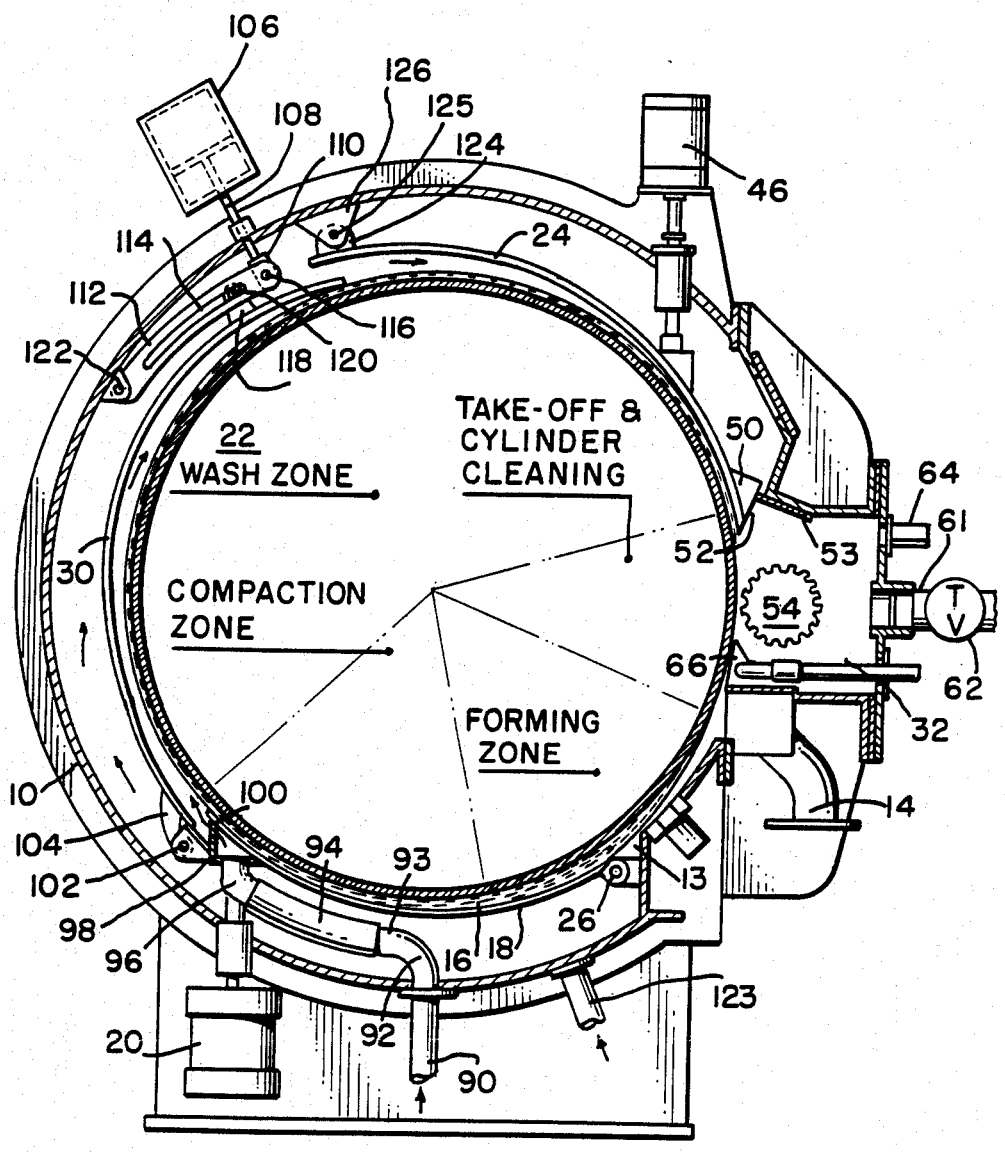
FIG. 3 is a front sectional view showing a third embodiment of the invention.

Most of the parts shown in the embodiment of FIG. 3 are the same as corresponding parts in the embodiment of FIG. 1 and the embodiment of FIG. 2.

Referring to FIG. 3, the first washing liquid inlet 90 extends into the vat 10 by means of a metal tube 92 having a portion 93 turned to extend toward the downstream end of the vat. Metal portion 93 extends into one end of a rubber sleeve 94 which in turn surrounds the end of a tubular member 96 which is attached to a bracket 98 connected to the first compaction baffle 18. The bracket 98 is provided with an opening 100 through which the washing liquid entering the washing inlet 90 flows.

The washing liquid then flows along the inside surface of the excluder baffle 30 and along the inside surface of the secondary compaction baffle 24.

The downstream end of the primary compaction baffle 18 is pivotably connected to the upstream end of the excluder baffle 30 by means of a pivot pin 102 extending through bracket 104.

An actuator 106 applies a compaction force against the excluder baffle 30. piston rod 108 extends from actuator 106 to the generally radially extending member 110. An arm 112 having a slot 114 is connected to the member 110 by pin 116. Bracket 118, connected to the excluder baffle 30 has a peg 120 which fits within slot 114 in the arm 112. The arm 112 is pivoted to vat 10 by pivot pin 122.

A second washing liquid inlet 123 extends into the vat 10 upstream from the first washing inlet 90. Liquid entering the wash liquid inlet 123 flows along the outside of primary compaction baffle 18, then along the outside of the excluder baffle 30, and then along the inside of the secondary compaction baffle 24. The secondary compaction baffle 24 is provided at its upstream end with a bracket 124 which is pivotably connected by pivot pin 125 to bracket 126 extending from the wall of vat 10. The second washing liquid may be at a different temperature or concentration from the washing liquid fed through washing liquid inlet 90. Also, even though two washing liquid inlets are shown, more than two washing liquid inlets may be provided, if desired.

In the operation of the embodiment of FIG. 3, pulp entering inlet 14 is compacted in the compaction zone by the primary compaction baffle 18 to form the mat 16. The mat 16 thereafter flows under the excluder baffle 30 and under the secondary compaction baffle 24 as it is washed in the wash zone of the drum. The secondary compaction baffle 24 again compacts the mat 16. In the take-off chamber 32, the mat is removed from the drum by the take-off roll 54 and longitudinally conveyed along the flutes of the take-off roll 54 to the pulp outlet 61 controlled by throttle valve 62. If desired, the consistency of the pulp in the take-off chamber 32 may be controlled by adding dilution liquid into the take-off chamber 32 through dilution liquid inlet 64.

I claim:

1. A pulp washer comprising a rotatable drum; an air tight vat completely enclosing the rotatable drum, said vat being constructed so that the rotatable drum may be completely submerged in liquid so that liquid surrounds the entire circumference of the drum, the vat having a liquid filled take-off chamber; a pulp inlet to the vat; means directly following the pulp inlet for forming and compacting the pulp to form a pulp mat; means for washing the pulp mat directly following the means for forming and compacting the pulp; means for again compacting the pulp mat; means for controlling consistency of the pulp removed from said pulp washer including means for removing the pulp mat from the drum and conveying it towards a pulp outlet, the removal point being located in the liquid filled take-off chamber to provide a pulp suspension at said removal point in said chamber; and said pulp outlet extending form the liquid filled take-off chamber.

2. A pulp washer in accordance with claim 1 wherein the means for removing the pulp mat from the drum is a take-off roll which removes the pulp mat and conveys the pulp slurry to the pulp outlet.

3. A pulp washer in accordance with claim 2 wherein the means for again compacting the pulp is a compaction baffle extending at least partially along the wash zone and and into the liquid filled take-off chamber.

4. A pulp washer in accordance with claim 3 wherein the means directly following the pulp inlet for forming and compacting the pulp to form a pulp mat comprises a compaction baffle.

5. A pulp washer in accordance with claim 4 wherein the compaction baffle extends along a drum forming zone and compacting zone, the means for washing the pulp mat on the drum comprises a drum wash zone extending circumferentially from the downstream end of the compaction baffle to the liquid filled take-off chamber and a washing liquid inlet to the vat circumferentially located so that washing liquid flows along the outside of the compaction baffle, and then into the drum along the wash zone.

6. A pulp washer in accordance with claim 4 wherein the compaction baffle extends along a drum forming zone and compacting zone and the means for washing the pulp mat on the drum comprises a drum wash zone extending circumferentially from the downstream end of the compaction baffle to the liquid filled take-off chamber, a coaxial baffle extending from the compaction baffle partially along the wash zone, and connected to the compaction baffle extending into the liquid filled take-off chamber, said compaction baffle converging toward the drum from the coaxial baffle to the liquid filled take-off chamber, a washing liquid inlet to the vat circumferentially located so that washing liquid flows along the outside of the compaction baffle, the coaxial baffle and the converging baffle being constructed so that washing liquid also flows along the inside surface and outside surface of the coaxial baffle and along the inside surface and outside surface of the converging baffle.

7. A pulp washer in accordance with claim 6 wherein the means for washing the pulp mat on the drum also includes a second washing liquid inlet to the vat located circumferentially at the coaxial baffle - converging baffle interconnection, the liquid fed to the second washing liquid inlet flowing along the inside surface and outside surface of the converging baffle.

8. A pulp washer in accordance with claim 7 wherein the vat has a dilution inlet for feeding dilution liquid into the take-off chamber.

* * * * *